US010534307B2

(12) United States Patent
Mizuno et al.

(10) Patent No.: US 10,534,307 B2
(45) Date of Patent: Jan. 14, 2020

(54) IMAGE FORMING APPARATUS

(71) Applicant: KONICA MINOLTA, INC., Chiyoda-ku, Tokyo (JP)

(72) Inventors: Hiroshi Mizuno, Aisai (JP); Hideaki Ikeda, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/426,219

(22) Filed: May 30, 2019

(65) Prior Publication Data

US 2019/0369544 A1 Dec. 5, 2019

(30) Foreign Application Priority Data

Jun. 4, 2018 (JP) ..... 2018-106856

(51) Int. Cl.
*G03G 15/00* (2006.01)
*G03G 21/16* (2006.01)

(52) U.S. Cl.
CPC ..... *G03G 15/751* (2013.01); *G03G 21/1671* (2013.01)

(58) Field of Classification Search
CPC ..... G03G 15/751; G02G 21/1671
See application file for complete search history.

(56) References Cited

U.S. PATENT DOCUMENTS 5,440,377 A * 8/1995 Izawa ..... G03G 15/0126 399/223
5,669,042 A * 9/1997 Kobayashi ..... G03G 15/0896 399/111
8,626,024 B2 * 1/2014 Wu ..... G03G 21/1821 399/111
2010/0239312 A1 * 9/2010 Kikuchi ..... G03G 21/1821 399/111
2018/0173132 A1 * 6/2018 Tsukada ..... G03G 15/04054

FOREIGN PATENT DOCUMENTS

JP 2016166979 A 9/2016

* cited by examiner

*Primary Examiner* — G. M. A Hyder
(74) *Attorney, Agent, or Firm* — Buchanan Ingersoll & Rooney PC

(57) ABSTRACT

An image forming apparatus includes: an image carrier that includes a rotating shaft, and is rotatable around the rotating shaft; a plurality of functional members disposed along an outer periphery of the image carrier; and a plurality of distance regulating members that maintains a constant distance between each of the plurality of functional members and the image carrier, wherein the plurality of functional members includes a first functional member and a second functional member, the plurality of distance regulating members includes a first distance regulating member and a second distance regulating member, the first distance regulating member includes a first abutting surface, the second distance regulating member includes a second abutting surface, and the first abutting surface and the second abutting surface are disposed side by side in a circumferential direction on the peripheral surface of the rotating shaft.

9 Claims, 4 Drawing Sheets

IMAGE FORMING APPARATUS

The entire disclosure of Japanese patent Application No. 2018-106856, filed on Jun. 4, 2018, is incorporated herein by reference in its entirety.

BACKGROUND

Technological Field

The present disclosure relates to an image forming apparatus.

Description of the Related Art

An image forming apparatus disclosed in JP 2016-166979 A includes distance regulating members for maintaining a constant distance between a photoreceptor, as an image carrier, and a developing roller.

The image forming apparatus disclosed in JP 2016-166979 A includes a pair of distance regulating rollers provided on respective sides of the rotating shaft of the developing roller. The pair of distance regulating rollers is received by a first receiving part and a second receiving part provided at respective ends of the rotating shaft of the photoreceptor.

In addition to the developing roller, a plurality of functional members such as a charging device and an exposure head is disposed around the photoreceptor. However, the distance regulating members described in JP 2016-166979 A can regulate only the distance between the developing roller and the photoreceptor.

When the distance regulating members are disposed side by side in the axial direction so as to support the plurality of functional members, it is necessary to increase the length of the rotating shaft of the photoreceptor. In addition, the rotating shaft of the image carrier is pressed by each of the distance regulating members at different positions. Therefore, the rotating shaft of the image carrier easily warps.

SUMMARY

The present disclosure has been made in consideration of the problems as described above, and an object of the present disclosure is to provide an image forming apparatus capable of regulating the distances between an image carrier and a plurality of functional members disposed around the image carrier while preventing a warp of the rotating shaft of the image carrier.

To achieve the abovementioned object, according to an aspect of the present invention, an image forming apparatus reflecting one aspect of the present invention comprises: an image carrier that includes a rotating shaft, and is rotatable around the rotating shaft; a plurality of functional members disposed along an outer periphery of the image carrier; and a plurality of distance regulating members that maintains a constant distance between each of the plurality of functional members and the image carrier, wherein the plurality of functional members includes a first functional member and a second functional member, the plurality of distance regulating members includes a first distance regulating member and a second distance regulating member, the first distance regulating member maintaining a constant distance between the first functional member and the image carrier, the second distance regulating member maintaining a constant distance between the second functional member and the image carrier, the first distance regulating member includes a first abutting surface that abuts against a part of a peripheral surface of the rotating shaft, the second distance regulating member includes a second abutting surface that abuts against another part of the peripheral surface of the rotating shaft, and the first abutting surface and the second abutting surface are disposed side by side in a circumferential direction on the peripheral surface of the rotating shaft, within a predetermined section along an axial direction of the rotating shaft.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
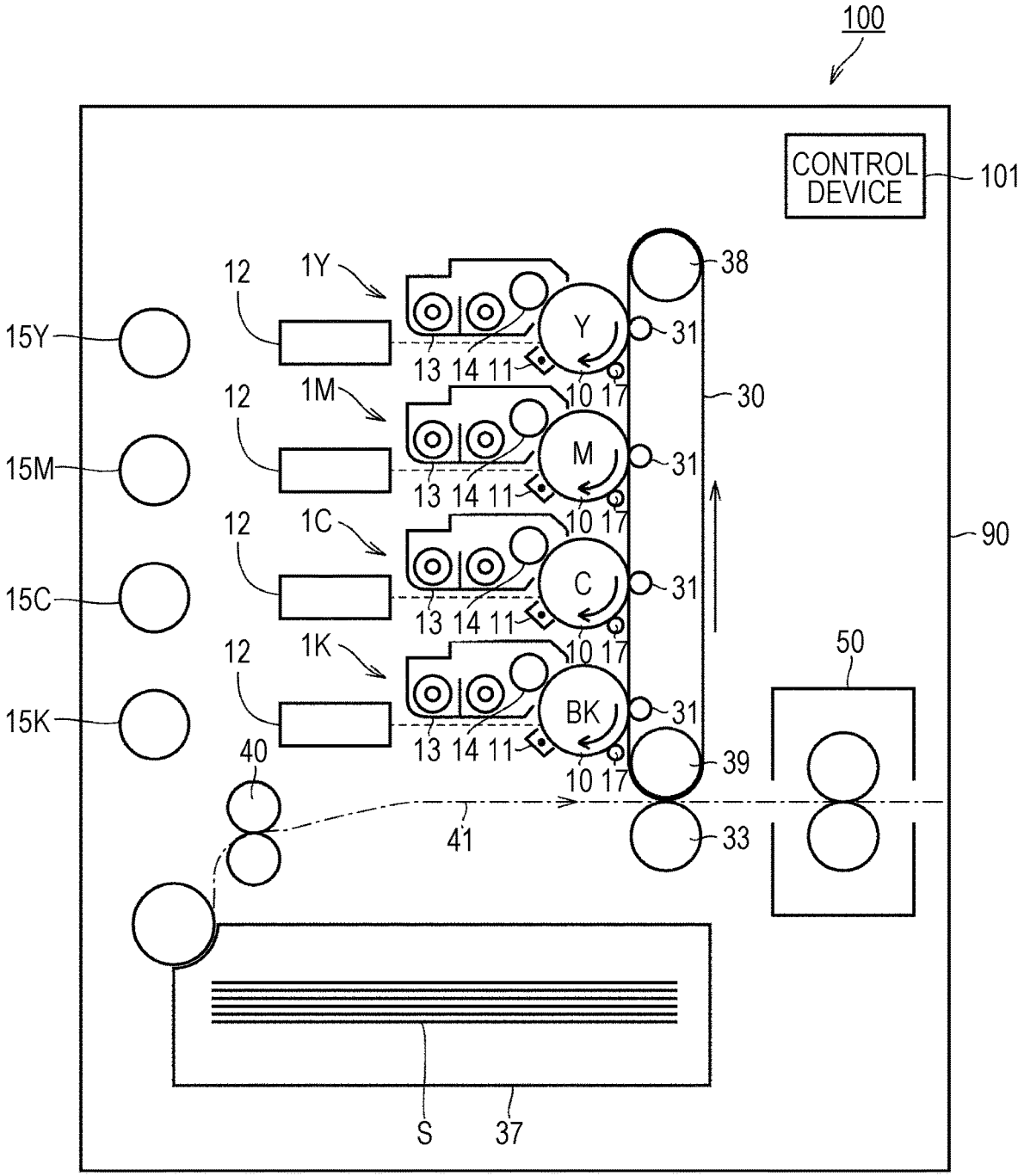
FIG. 1 is a schematic diagram of an image forming apparatus according to a first embodiment.

Hereinafter, one or more embodiments of the present invention will be described with reference to the drawings. However, the scope of the invention is not limited to the disclosed embodiments. Note that the same or common parts are denoted by the same reference signs in the drawings, and description thereof will not be repeated in the following embodiments.

First Embodiment

FIG. 1 is a schematic diagram of an image forming apparatus according to a first embodiment. With reference to FIG. 1, an image forming apparatus 100 according to the first embodiment will be described.

FIG. 1 shows the image forming apparatus 100 as a color printer. Hereinafter, the image forming apparatus 100 as a color printer will be described. However, the image forming apparatus 100 is not limited to a color printer. For example, the image forming apparatus 100 may be a monochrome printer, a fax machine, or a multi-functional peripheral (MFP) having functions of a monochrome printer, a color printer, and a fax machine.

The image forming apparatus 100 includes image forming units 1Y, 1M, 1C, and 1K, an intermediate transfer belt 30, primary transfer rollers 31, a secondary transfer roller 33, a cassette 37, a driven roller 38, a driving roller 39, timing rollers 40, a fixing device 50, a housing 90, and a control device 101.

The housing 90 defines the outer shell of the image forming apparatus 100. The housing 90 includes therein the image forming units 1Y, 1M, 1C, and 1K, the intermediate transfer belt 30, the primary transfer rollers 31, the secondary transfer roller 33, the cassette 37, the driven roller 38, the driving roller 39, the timing rollers 40, the fixing device 50, and the control device 101.

An image forming part is formed by the image forming units 1Y, 1M, 1C, and 1K, the intermediate transfer belt 30, the primary transfer rollers 31, the secondary transfer roller 33, the cassette 37, the driven roller 38, the driving roller 39, and the timing rollers 40. The image forming part forms a toner image on a paper sheet S as a recording medium conveyed along a conveying path 41 to be described below.

The image forming units 1Y, 1M, 1C, and 1K are arranged in order along the intermediate transfer belt 30. The image forming unit 1Y receives toner supply from a toner bottle 15Y to form a yellow (Y) toner image. The image forming unit 1M receives toner supply from a toner bottle 15M to form a magenta (M) toner image. The image forming unit 1C receives toner supply from a toner bottle 15C to form a cyan (C) toner image. The image forming unit 1K receives toner supply from a toner bottle 15K to form a black (BK) toner image.

The image forming units 1Y, 1M, 1C, and 1K are arranged in order along the intermediate transfer belt 30 in the direction of rotation of the intermediate transfer belt 30. Each of the image forming units 1Y, 1M, 1C, and 1K includes a photoreceptor 10, as an image carrier, and a plurality of functional members. The plurality of functional members includes, for example, a charging device 11, an exposure device 12, a developing device 13, and a cleaning device 17.

The charging device 11 uniformly charges the surface of the photoreceptor 10. The exposure device 12 irradiates the photoreceptor 10 with laser light in accordance with a control signal from the control device 101 to expose the surface of the photoreceptor 10 according to an input image pattern. As a result, an electrostatic latent image corresponding to the input image is formed on the photoreceptor 10.

While rotating a developing roller 14, the developing device 13 applies a developing bias to the developing roller 14 to cause toner to be attached to the surface of the developing roller 14. Therefore, the toner is transferred from the developing roller 14 to the photoreceptor 10, and thus, a toner image corresponding to the electrostatic latent image is developed on the surface of the photoreceptor 10.

The photoreceptor 10 and the intermediate transfer belt 30 are in contact with each other at a part where the primary transfer roller 31 is provided. The primary transfer roller 31 has a roller shape, and is rotatable. A transfer voltage having a polarity opposite to that of the toner image is applied to the primary transfer roller 31. As a result, the toner image is transferred from the photoreceptor 10 to the intermediate transfer belt 30. The yellow (Y) toner image, the magenta (M) toner image, the cyan (C) toner image, and the black (BK) toner image are transferred from the photoreceptor 10 to the intermediate transfer belt 30 while being sequentially superimposed on the intermediate transfer belt 30. As a result, a color toner image is formed on the intermediate transfer belt 30.

The intermediate transfer belt 30 is stretched around the driven roller 38 and the driving roller 39. The driving roller 39 is rotationally driven by, for example, a motor (not shown). The intermediate transfer belt 30 and the driven roller 38 rotate in conjunction with the driving roller 39. As a result, the toner image on the intermediate transfer belt 30 is conveyed to the secondary transfer roller 33.

The cleaning device 17 is pressed against the photoreceptor 10. The cleaning device 17 recovers toner remaining on the surface of the photoreceptor 10 after the transfer of the toner image.

The paper sheets S are set in the cassette 37. The timing rollers 40 feed the paper sheets S one by one from the cassette 37 to the secondary transfer roller 33 along the conveying path 41. The secondary transfer roller 33 has a roller shape, and is rotatable. The secondary transfer roller 33 applies a transfer voltage having a polarity opposite to that of the toner image, to the paper sheet S being conveyed. As a result, the toner image is attracted to the secondary transfer roller 33 from the intermediate transfer belt 30. Thus, the toner image on the intermediate transfer belt 30 is transferred. The timing of conveying the paper sheet S to the secondary transfer roller 33 is adjusted by the timing rollers 40 in accordance with the position of the toner image on the intermediate transfer belt 30. The timing rollers 40 cause the toner image on the intermediate transfer belt 30 to be transferred to the paper sheet S at an appropriate position on the paper sheet S.

The fixing device 50 applies pressure and heat to the paper sheet S passing therethrough. As a result, the toner image is fixed on the paper sheet S. In this way, the fixing device 50 fixes the toner image on the paper sheet S conveyed along the conveying path 41. The paper sheet S with the toner image fixed thereon is discharged onto a tray.

Note that although the image forming apparatus 100 using the tandem system as a printing method has been described above, the printing method of the image forming apparatus 100 is not limited to the tandem system. The arrangement of each component in the image forming apparatus 100 can be changed as appropriate in accordance with a printing method to be adopted. The rotary method or direct transfer method may be adopted as a printing method of the image forming apparatus 100. In the case of adopting the rotary method, the image forming apparatus 100 includes the single photoreceptor 10 and a plurality of the developing devices 13 that is coaxially rotatable. At the time of printing, the image forming apparatus 100 sequentially leads each of the developing devices 13 to the photoreceptor 10 to develop a toner image of each color. In the case of adopting the direct transfer method, the image forming apparatus 100 causes a toner image formed on the photoreceptor 10 to be directly transferred to the paper sheet S.

Figure 2:
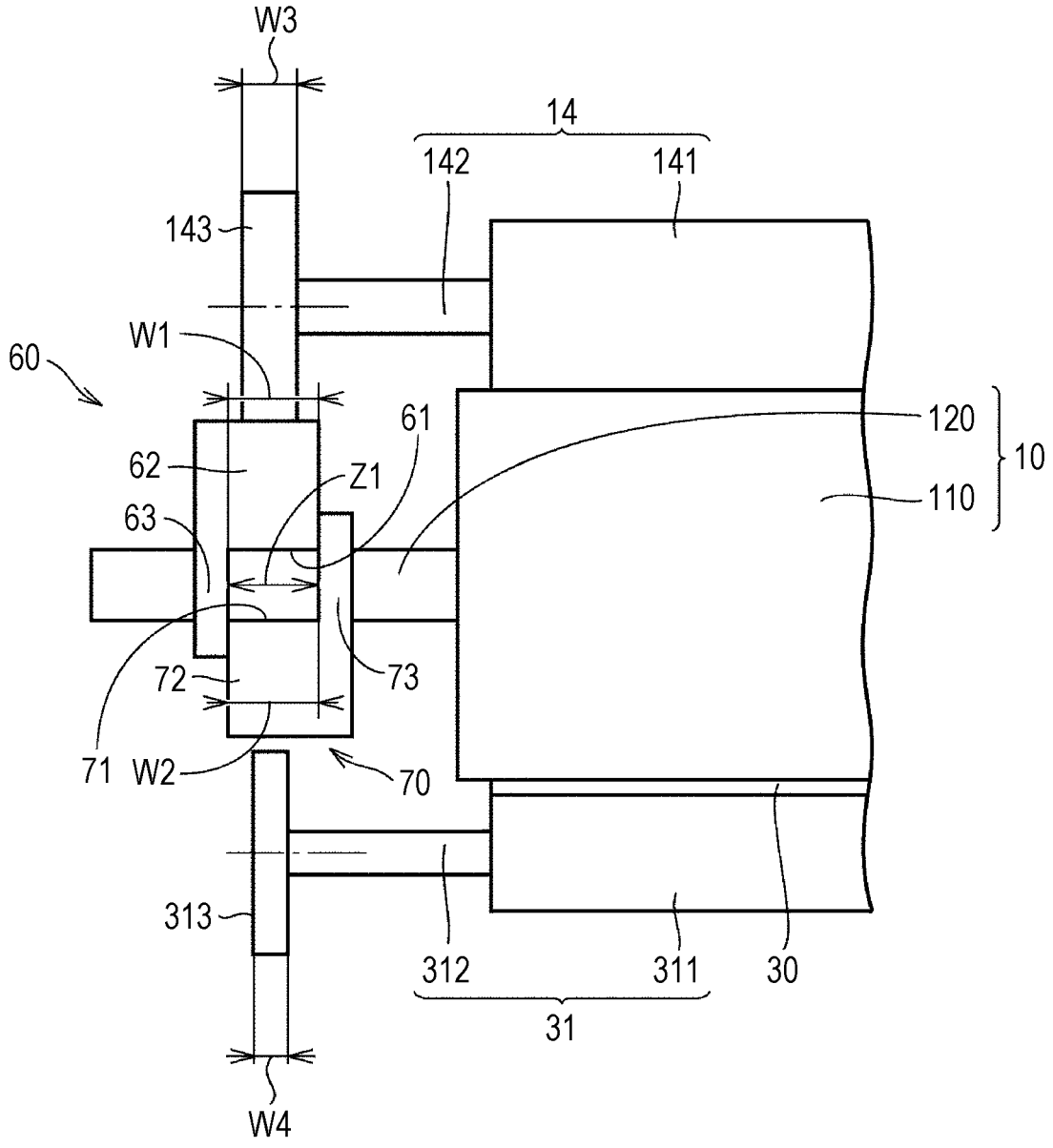
FIG. 2 is a schematic view of a structure around a photoreceptor according to the first embodiment.
Figure 3:
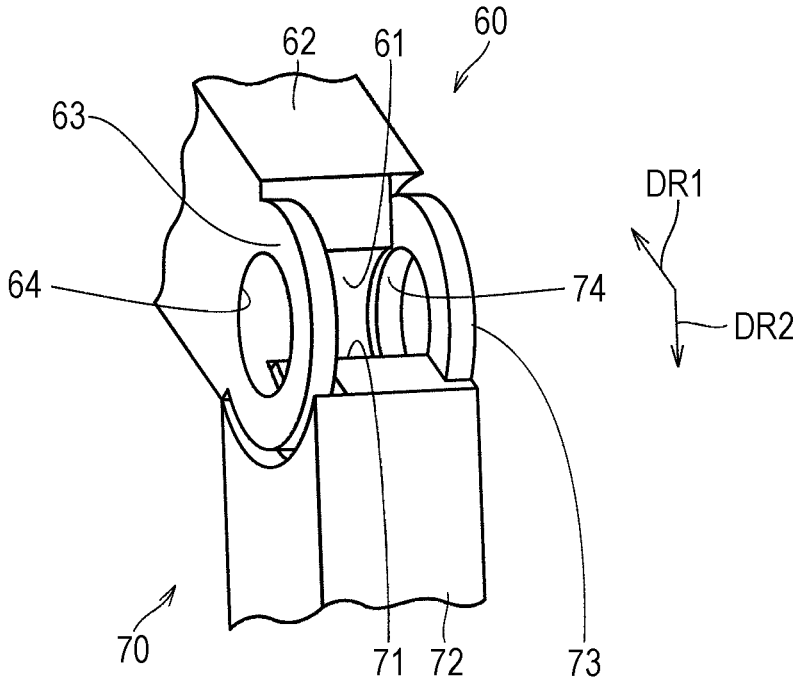
FIG. 3 is a schematic view of a plurality of distance regulating members according to the first embodiment.

FIG. 2 is a view of a structure around the photoreceptor according to the first embodiment. FIG. 3 is a view of a plurality of distance regulating members according to the first embodiment. The plurality of distance regulating members will be described with reference to FIGS. 2 and 3.

Note that the plurality of distance regulating members included in the image forming apparatus 100 is exemplified by a first distance regulating member 60 and a second distance regulating member 70 in the present embodiment. The first distance regulating member 60 maintains a constant distance between the photoreceptor 10 and the developing roller 14. The second distance regulating member 70 maintains a constant distance between the photoreceptor 10 and the primary transfer roller 31.

For example, the developing roller 14 and the primary transfer roller 31 are disposed around the photoreceptor 10, as shown in FIG. 2. The photoreceptor 10 includes a drum 110 and a shaft 120. The drum 110 rotates around the rotation axis of the shaft 120. The above-described electrostatic latent image is formed on the surface of the drum 110. The shaft 120 has a cylindrical shape. A pair of the first distance regulating members 60 and a pair of the second distance regulating members 70 are each provided at respective ends of the shaft 120.

The developing roller 14 includes a roller portion 141 that carries developer, and a shaft 142. The roller portion 141 is provided with a development sleeve that carries the developer. The development sleeve is rotatable around the axis of the shaft 142. The shaft 142 has a cylindrical shape. A pair of first abutting parts 143 is attached to respective ends of the shaft 142.

The primary transfer roller 31 includes a roller portion 311 and a shaft 312. The roller portion 311 is disposed to face the drum 110 of the photoreceptor 10 with the intermediate transfer belt 30 interposed therebetween, so that a nip is formed between the roller portion 311 and the drum 110. The roller portion 311 rotates as the shaft 312 rotates. The shaft 312 has a cylindrical shape. A pair of second abutting parts 313 is attached to respective ends of the shaft 312.

The first distance regulating member 60 maintains a constant distance between the photoreceptor 10 and the developing roller 14 by keeping the distance between the shaft 120 of the photoreceptor 10 and the shaft 142 of the developing roller 14 constant along the axial direction. Note that the distance between the photoreceptor 10 and the developing roller 14 refers to the distance between the surface of the drum 110 and the surface of the roller portion 141.

The pair of first abutting parts 143 described above abuts against the pair of first distance regulating members 60. As a result, the distance between the shaft 120 and the shaft 142 is kept constant.

The first distance regulating member 60 includes a first abutting surface 61, a first extending part 62, and a ring part 63. The first abutting surface 61 is shaped along the peripheral surface of the shaft 120. The first abutting surface 61 abuts against a part of the peripheral surface of the shaft 120. Specifically, the first abutting surface 61 abuts against a part of the peripheral surface of the shaft 120 within a predetermined section Z1 along the axial direction of the shaft 120 (rotation axis).

The first extending part 62 is provided in such a way as to extend from the first abutting surface 61 in a first direction (direction of DR1 in FIG. 3) orthogonal to the axial direction of the shaft 120. The first abutting part 143 abuts against the distal end of the first extending part 62 in the first direction.

A width W1 of a distal end portion of the first extending part 62, along the axial direction of the shaft 120, is larger than a width W3 of the first abutting part 143, along the axial direction. Thus, it is possible to cause the first abutting part 143 to stably abut against the first extending part 62, and to prevent the developing roller 14, to which the first abutting part 143 has been attached, from inclining.

Furthermore, it is also possible to reduce an installation space for the developing roller 14, as a first functional member, by making the above-described width W3 of the first abutting part 143 smaller than the width W1 of the first extending part 62. Thus, it is possible to avoid an increase in the length of the shaft 120 of the photoreceptor 10. As a result, the deflection of the photoreceptor 10 can be prevented.

Note that the width W1 of the distal end portion of the first extending part 62, along the axial direction described above, may be larger than the width of the first abutting surface 61, along the axial direction described above.

When the width of the first extending part 62 on the first abutting surface 61 side increases, the length of the shaft 120 along the axial direction also increases. It is possible to avoid an increase in the length of the shaft 120 and also to cause the first abutting part 143 to stably abut against the distal end portion of the first extending part 62 by making the width of the first extending part 62 on the first abutting surface 61 side smaller than the width W1 of the distal end portion of the first extending part 62. This can also serve to avoid an increase in the length of the shaft 120 of the photoreceptor 10. Thus, the deflection of the photoreceptor 10 can be prevented.

The ring part 63 is provided at one end of the first extending part 62 on the rotation axis of the shaft 120. The ring part 63 protrudes from the first extending part 62 in a direction opposite to the first direction. There is provided, in the ring part 63, a through hole 64 penetrating through the ring part 63 in the axial direction of the shaft 120. It is possible to prevent the first distance regulating member 60 from falling off the shaft 120 by inserting the shaft 120 into the through hole 64.

The ring part 63 is engaged with one end of a second extending part 72 on the rotation axis of the shaft 120. Specifically, the ring part 63 is fitted in a recess provided at the one end of the above-described second extending part 72. A part of the first distance regulating member 60 is thus engaged with a part of the second distance regulating member 70. As a result, it is possible to perform the positioning of the first distance regulating member 60 and the second distance regulating member 70.

The second distance regulating member 70 maintains a constant distance between the photoreceptor 10 and the primary transfer roller 31 by keeping the distance between the shaft 120 of the photoreceptor 10 and the shaft 312 of the primary transfer roller 31 constant along the axial direction. Thus, the second distance regulating member 70 keeps the distance between the intermediate transfer belt 30 wound around the primary transfer roller 31 and the photoreceptor 10 constant along the axial direction. Note that the distance between the photoreceptor 10 and the primary transfer roller 31 refers to the distance between the surface of the drum 110 and the surface of the roller portion 311.

The pair of second abutting parts 313 described above abuts against the pair of second distance regulating members 70. As a result, the distance between the shaft 120 and the shaft 312 is kept constant.

The second distance regulating member 70 includes a second abutting surface 71, the second extending part 72, and a ring part 73. The second abutting surface 71 is shaped along the peripheral surface of the shaft 120. The second abutting surface 71 abuts against another part of the peripheral surface of the shaft 120. Specifically, the second abutting surface 71 abuts against the peripheral surface of the shaft 120 at a part different from the part of the peripheral surface of the shaft 120, against which the first abutting surface 61 abuts, within the above-described section Z1.

The second abutting surface 71 and the first abutting surface 61 are disposed side by side in the circumferential direction on the peripheral surface of the shaft 120 within the above-described section Z1. The width of the second abutting surface 71 along the axial direction of the shaft 120 is substantially equal to the width of the first abutting surface 61 along the axial direction. Note that the expression "substantially equal" means allowing for a margin of manufacturing error.

The second extending part 72 is provided in such a way as to extend from the second abutting surface 71 in a direction different from the first direction, that is, in a second direction (direction of DR2 in FIG. 3). The second direction is orthogonal to the axial direction of the shaft 120. The second abutting part 313 abuts against the distal end of the second extending part 72 in the second direction.

A width W2 of a distal end portion of the second extending part 72, along the axial direction of the shaft 120, is larger than a width W4 of the second abutting part 313, along the axial direction. As a result, it is possible to cause the second abutting part 313 to stably abut against the second extending part 72, and to prevent the primary transfer roller 31, to which the second abutting part 313 has been attached, from inclining. Thus, it is possible to prevent the intermediate transfer belt 30 wound around the primary transfer roller 31 from inclining.

Furthermore, it is also possible to reduce an installation space for the primary transfer roller 31, as a second functional member, by making the above-described width W4 of the second abutting part 313 smaller than the width of the second extending part 72. Thus, it is possible to avoid an increase in the length of the shaft 120 of the photoreceptor 10. As a result, the deflection of the photoreceptor 10 can be prevented.

The ring part 73 is provided at the other end of the second extending part 72 on the rotation axis of the shaft 120. The ring part 73 protrudes from the second extending part 72 in a direction opposite to the second direction. There is provided, in the ring part 73, a through hole 74 penetrating through the ring part 73 in the axial direction of the shaft 120. It is possible to prevent the second distance regulating member 70 from falling off the shaft 120 by inserting the shaft 120 into the through hole 74.

The ring part 73 is engaged with the other end of the first extending part 62 on the rotation axis of the shaft 120. Specifically, the ring part 73 is fitted in a recess provided at the other end of the above-described first extending part 62.

Figure 4:
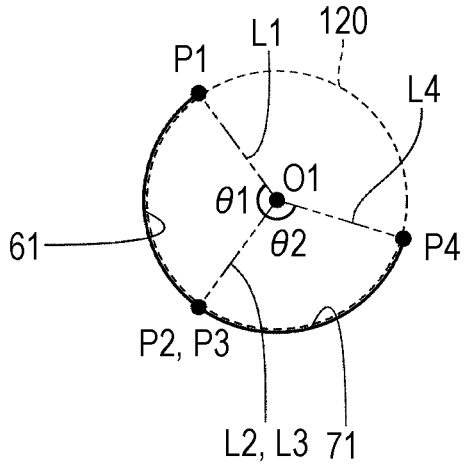
FIG. 4 is a schematic diagram for describing details of a first abutting surface and a second abutting surface according to the first embodiment.

FIG. 4 is a diagram for describing details of the first abutting surface and the second abutting surface according to the first embodiment. In FIG. 4, the peripheral surface of the shaft 120 is indicated by a broken line, and the first abutting surface 61 and the second abutting surface 71 are indicated by solid lines.

As shown in FIG. 4, it is preferable to dispose the first abutting surface 61 and the second abutting surface 71 such that the first abutting surface 61 and the second abutting surface 71 are contiguous to each other in the above-described circumferential direction. Thus, the first abutting surface 61 and the second abutting surface 71 can stably abut against the peripheral surface of the shaft 120.

Let θ1 be an angle between a first straight line L1 and a second straight line L2 as seen along the axial direction of the shaft 120, the first straight line L1 connecting one end P1 of the first abutting surface 61 in the circumferential direction of the shaft 120 and a shaft center O1 of the shaft 120, the second straight line L2 connecting the other end P2 of the first abutting surface 61 in the circumferential direction of the shaft 120 and the above-described shaft center O1. Then, the angle θ1 is not less than 60 degrees and not more than 180 degrees. That is, when seen along the axial direction of the shaft 120, the central angle of an arc formed by the first abutting surface 61 is not less than 60 degrees and not more than 180 degrees.

Similarly, let θ2 be an angle between a third straight line L3 and a fourth straight line L4 as seen along the axial direction of the shaft 120, the third straight line L3 connecting one end P3 of the second abutting surface 71 in the circumferential direction of the shaft 120 and the shaft center O1 of the shaft 120, the fourth straight line L4 connecting the other end P4 of the second abutting surface 71 in the circumferential direction of the shaft 120 and the above-described shaft center O1. Then, the angle θ2 is not less than 60 degrees and not more than 180 degrees. That is, when seen along the axial direction of the shaft 120, the central angle of an arc formed by the second abutting surface 71 is not less than 60 degrees and not more than 180 degrees.

As a result of establishing an angular relationship as described above, the first abutting surface 61 and the second abutting surface 71 can be disposed side by side in the circumferential direction on the peripheral surface of the shaft 120. Furthermore, it is possible to stabilize the positions of the first distance regulating member 60 and the second distance regulating member 70 by setting the above-described angles θ1 and θ2 to angles of 60 degrees or more.

In the image forming apparatus 100 according to the first embodiment described above, the first abutting surface 61 of the first distance regulating member 60 and the second abutting surface 71 of the second distance regulating member 70 are arranged side by side in the circumferential direction on the peripheral surface of the shaft 120, within the same predetermined section along the axial direction of the shaft 120. The first abutting surface 61 abuts against the shaft 120 of the photoreceptor 10. The second abutting surface 71 also abuts against the shaft 120 of the photoreceptor 10.

As a result of the first distance regulating member 60 being pressed by the developing roller 14 as the first functional member, the first abutting surface 61 presses a part of the shaft 120. In addition, as a result of the second distance regulating member 70 being pressed by the primary transfer roller 31 as the second functional member, the second abutting surface 71 presses a part of the shaft 120. The respective parts of the shaft 120 pressed by the first abutting surface 61 and the second abutting surface 71 are present in the same section in the axial direction of the shaft 120, due to the above-described arrangement of the first abutting surface 61 and the second abutting surface 71.

Thus, it is possible to prevent pressing force from being applied to the shaft 120 at different positions, in comparison with the case where the shaft 120 is pressed by the first abutting surface 61 and the second abutting surface 71 at separate positions along the axial direction of the shaft 120. As a result, it is possible to prevent deformation of the shaft 120 and also prevent a warp of the shaft 120 even in the case where a plurality of distance regulating members is provided.

Second Embodiment

Figure 5:
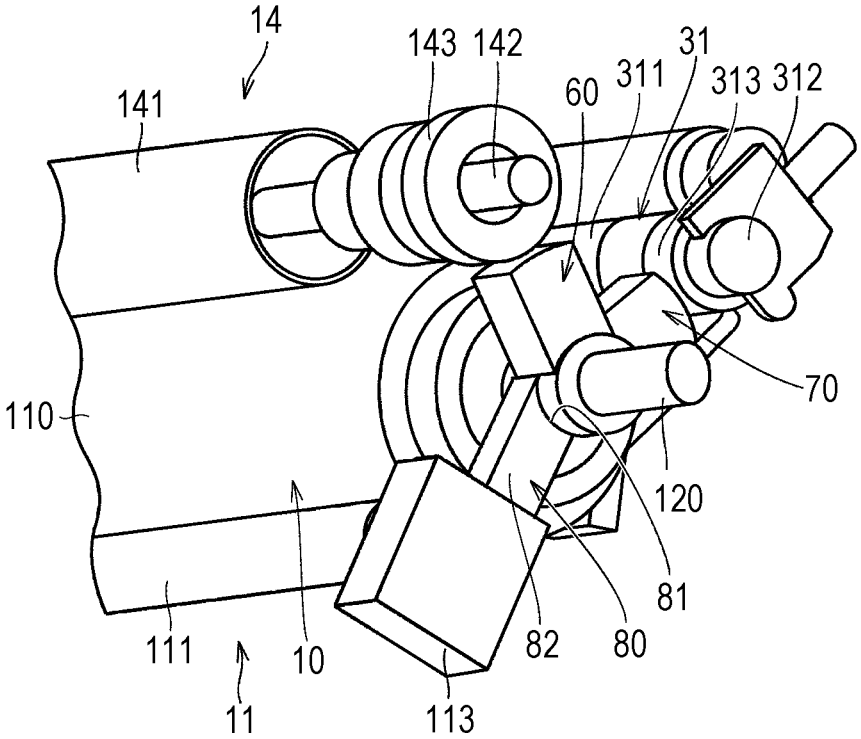
FIG. 5 is a schematic view of a structure around a photoreceptor according to a second embodiment.

FIG. 5 is a view of a structure around a photoreceptor according to a second embodiment. With reference to FIG. 5, an image forming apparatus according to the second embodiment will be described.

As shown in FIG. 5, the image forming apparatus according to the second embodiment differs from the image forming apparatus 100 according to the first embodiment in the number of a plurality of distance regulating members. Three distance regulating members are provided in the second embodiment. That is, the plurality of distance regulating members includes a first distance regulating member 60, a second distance regulating member 70, and a third distance regulating member 80.

The first distance regulating member 60 has a configuration similar to that in the first embodiment. The first distance regulating member 60 maintains a constant distance between a photoreceptor 10 and a developing roller 14. The second distance regulating member 70 has a configuration similar to that in the first embodiment. The second distance regulating member 70 maintains a constant distance between the photoreceptor 10 and a primary transfer roller 31.

The third distance regulating member 80 has a configuration substantially similar to the configurations of the first distance regulating member 60 and the second distance regulating member 70. The third distance regulating member 80 maintains a constant distance between the photoreceptor 10 and a charging device 11. Specifically, the third distance regulating member 80 maintains a constant distance between the photoreceptor 10 and a discharge electrode 111 included in the charging device 11. A third abutting part 113 is attached to an end of the discharge electrode 111.

The third distance regulating member 80 includes a third abutting surface 81 and a third extending part 82. The third abutting surface 81 is shaped along the peripheral surface of a shaft 120. The third abutting surface 81 abuts against a part of the peripheral surface of the shaft 120. Specifically, the third abutting surface 81 abuts against the peripheral surface of the shaft 120 at a part different from respective parts of the peripheral surface of the shaft 120, against which a first abutting surface 61 and a second abutting surface 71 abut, within a section Z1 that is similar to that in the first embodiment.

The first abutting surface 61, the second abutting surface 71, and the third abutting surface 81 are disposed side by side in the circumferential direction on the peripheral surface of the shaft 120, within the above-described section Z1.

The third extending part 82 is provided in such a way as to extend from the third abutting surface 81 in a direction different from a first direction and a second direction, that is, in a third direction. The third direction is orthogonal to the axial direction of the shaft 120. The third abutting part 113 abuts against the distal end of the third extending part 82 in the third direction.

Figure 6:
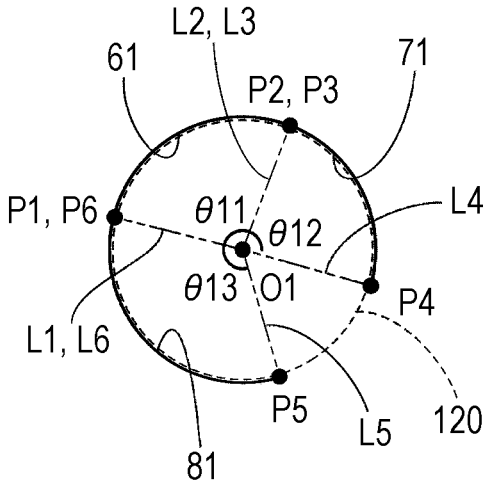
FIG. 6 is a schematic diagram for describing details of a first abutting surface, a second abutting surface, and a third abutting surface according to the second embodiment.

FIG. 6 is a schematic diagram for describing details of the first abutting surface, the second abutting surface, and the third abutting surface according to the second embodiment. With reference to FIG. 6, details of the first abutting surface 61, the second abutting surface 71, and the third abutting surface 81 will be described.

As shown in FIG. 6, it is preferable that the first abutting surface 61, the second abutting surface 71, and the third abutting surface 81 be arranged in a contiguous manner in the circumferential direction of the shaft 120. Thus, the first abutting surface 61, the second abutting surface 71, and the third abutting surface 81 can stably abut against the shaft 120.

Let θ11 be an angle between a first straight line L1 and a second straight line L2 as seen along the axial direction of the shaft 120, the first straight line L1 connecting one end P1 of the first abutting surface 61 in the circumferential direction of the shaft 120 and a shaft center O1 of the shaft 120, the second straight line L2 connecting the other end P2 of the first abutting surface 61 in the circumferential direction of the shaft 120 and the above-described shaft center O1. Then, the angle θ11 is not less than 60 degrees and not more than 120 degrees. That is, when seen along the axial direction of the shaft 120, the central angle of an arc formed by the first abutting surface 61 is not less than 60 degrees and not more than 120 degrees.

Similarly, let θ12 be an angle between a third straight line L3 and a fourth straight line L4 as seen along the axial direction of the shaft 120, the third straight line L3 connecting one end P3 of the second abutting surface 71 in the circumferential direction of the shaft 120 and the shaft center O1 of the shaft 120, the fourth straight line L4 connecting the other end P4 of the second abutting surface 71 in the circumferential direction of the shaft 120 and the above-described shaft center O1. Then, the angle θ12 is not less than 60 degrees and not more than 120 degrees. That is, when seen along the axial direction of the shaft 120, the central angle of an arc formed by the second abutting surface 71 is not less than 60 degrees and not more than 120 degrees.

Similarly, let θ13 be an angle between a fifth straight line L5 and a sixth straight line L6 as seen along the axial direction of the shaft 120, the fifth straight line L5 connecting one end P5 of the third abutting surface 81 in the circumferential direction of the shaft 120 and the shaft center O1 of the shaft 120, the sixth straight line L6 connecting the other end P6 of the third abutting surface 81 in the circumferential direction of the shaft 120 and the above-described shaft center O1. Then, the angle θ13 is not less than 60 degrees and not more than 120 degrees. In other words, when seen along the axial direction of the shaft 120, the central angle of an arc formed by the third abutting surface 81 is not less than 60 degrees and not more than 120 degrees.

That is, let n be the number of the plurality of distance regulating members (n is an integer from 2 to 6, inclusive), and let θ be an angle between a straight line connecting one end of an abutting surface in the circumferential direction of the shaft 120 and the shaft center O1 of the shaft 120, and a straight line connecting the other end of the abutting surface in the circumferential direction of the shaft 120 and the above-described shaft center O1. Then, it is preferable that the angle θ be not less than 60 degrees and not more than 120 degrees.

Even in the case of adopting the configuration as described above, the image forming apparatus according to the second embodiment can achieve substantially similar effects as those of the image forming apparatus 100 according to the first embodiment.

Note that the case where the first distance regulating member 60 maintains a constant distance between the photoreceptor 10 and the developing roller 14 has been described as an example in the first embodiment described above. However, the present invention is not limited thereto. Alternatively, the first distance regulating member 60 may maintain a constant distance between the photoreceptor 10 and the charging device or an exposure head. Furthermore, described above as an example is the case where the second distance regulating member 70 maintains a constant distance between the primary transfer roller 31 and the photoreceptor 10, and thus maintains a constant distance between the intermediate transfer belt 30 and the photoreceptor 10. However, the present invention is not limited thereto. The second distance regulating member 70 just needs to maintain a constant distance between the photoreceptor 10 and a functional member different from a functional member to be regulated by the first distance regulating member 60. The second distance regulating member 70 may maintain a constant distance between the photoreceptor 10 and the charging device or the exposure head.

According to an embodiment of the present disclosure, it is possible to provide an image forming apparatus capable of regulating the distances between an image carrier and a plurality of functional members disposed around the image carrier while preventing a warp of the rotating shaft of the image carrier.

Although embodiments of the present invention have been described and illustrated in detail, the disclosed embodiments are made for purposes of illustration and example only and not limitation. The scope of the present invention should be interpreted by terms of the appended claims, and all changes which come within the meaning and range of equivalency of the claims are therefore intended to be embraced therein.

What is claimed is:

1. An image forming apparatus comprising:

an image carrier that includes a rotating shaft, and is rotatable around the rotating shaft;

a plurality of functional members disposed along an outer periphery of the image carrier; and a plurality of distance regulating members that maintains a constant distance between each of the plurality of functional members and the image carrier, wherein the plurality of functional members includes a first functional member and a second functional member, the plurality of distance regulating members includes a first distance regulating member and a second distance regulating member, the first distance regulating member maintaining a constant distance between the first functional member and the image carrier, the second distance regulating member maintaining a constant distance between the second functional member and the image carrier, the first distance regulating member includes a first abutting surface that abuts against a part of a peripheral surface of the rotating shaft, the second distance regulating member includes a second abutting surface that abuts against another part of the peripheral surface of the rotating shaft, and the first abutting surface and the second abutting surface are disposed side by side in a circumferential direction on the peripheral surface of the rotating shaft, within a predetermined section along an axial direction of the rotating shaft.

2. The image forming apparatus according to claim 1, wherein a width of the first abutting surface along the axial direction and a width of the second abutting surface along the axial direction are substantially equal.

3. The image forming apparatus according to claim 1, wherein the first distance regulating member includes a first extending part extending from the first abutting surface in a first direction orthogonal to the axial direction, a first abutting part is attached to the first functional member, and abuts against the first extending part from a side opposite to a side where the first abutting surface is located in the first direction, and a width of an end part of the first extending part on a side facing the first abutting part, along the axial direction, is larger than a width of the first abutting part along the axial direction.

4. The image forming apparatus according to claim 3, wherein the second distance regulating member includes a second extending part extending from the second abutting surface in a second direction that is a direction different from the first direction, the second direction being orthogonal to the axial direction, a second abutting part is attached to the second functional member, and abuts against the second extending part from a side opposite to a side where the second abutting surface is located in the second direction, and a width of an end part of the second extending part on a side facing the second abutting part, along the axial direction, is larger than a width of the second abutting part along the axial direction.

5. The image forming apparatus according to claim 1, wherein at least one of the first distance regulating member and the second distance regulating member includes a ring-shaped part into which the rotating shaft is inserted.

6. The image forming apparatus according to claim 1, wherein the first abutting surface and the second abutting surface are disposed such that the first abutting surface and the second abutting surface are contiguous to each other in the circumferential direction.

7. The image forming apparatus according to claim 1, wherein a part of the first distance regulating member is fitted in a part of the second distance regulating member.

8. The image forming apparatus according to claim 1, wherein the plurality of functional members includes a developing roller, a transfer roller, a transfer belt, a charging device, and an exposure head.

9. The image forming apparatus according to claim 1, wherein an angle between a first straight line and a second straight line as seen along the axial direction is not less than 60 degrees and not more than 180 degrees, the first straight line connecting one end of the first abutting surface in the circumferential direction of the rotating shaft and a shaft center of the rotating shaft, the second straight line connecting another end of the first abutting surface in the circumferential direction of the rotating shaft and the shaft center of the rotating shaft, and an angle between a third straight line and a fourth straight line as seen along the axial direction is not less than 60 degrees and not more than 180 degrees, the third straight line connecting one end of the second abutting surface in the circumferential direction of the rotating shaft and the shaft center of the rotating shaft, the fourth straight line connecting another end of the second abutting surface in the circumferential direction of the rotating shaft and the shaft center of the rotating shaft.

* * * * *